US011498185B2

(12) United States Patent
Payeur

(10) Patent No.: US 11,498,185 B2
(45) Date of Patent: Nov. 15, 2022

(54) MAINTENANCE DEVICE

(71) Applicant: Craig Payeur, Sanford, ME (US)

(72) Inventor: Craig Payeur, Sanford, ME (US)

( * ) Notice: Subject to any disclaimer, the term of this patent is extended or adjusted under 35 U.S.C. 154(b) by 0 days.

(21) Appl. No.: 17/331,679

(22) Filed: May 27, 2021

(65) Prior Publication Data

US 2021/0370467 A1 Dec. 2, 2021

Related U.S. Application Data

(60) Provisional application No. 63/031,007, filed on May 28, 2020.

(51) Int. Cl.

| | |
|---|---|
| ***B24C 3/32*** | (2006.01) |
| ***B08B 9/08*** | (2006.01) |
| ***B24B 47/12*** | (2006.01) |
| ***E04H 12/30*** | (2006.01) |

(52) U.S. Cl.

CPC ..... *B24C 3/325* (2013.01); *B08B 9/0808* (2013.01); *E04H 12/30* (2013.01); *B24B 47/12* (2013.01)

(58) Field of Classification Search

CPC .. B24C 3/06; B24C 3/062; B24C 3/32; B24C 3/325; B08B 9/08; B08B 9/0808; B08B 9/0813; B24B 47/12; E04H 12/30; E04G 3/28; E04G 3/30; E04G 3/32; E04G 3/325; E04G 3/305

USPC ..... 451/1, 38, 75, 66, 76, 354; 15/246.5

See application file for complete search history.

(56) References Cited

U.S. PATENT DOCUMENTS

| | | | | |
|---|---|---|---|---|
| 1,864,934 | A * | 6/1932 | Reeves | E04G 1/362 182/14 |
| 3,306,396 | A * | 2/1967 | Goss | E04G 1/36 212/175 |
| 3,556,252 | A * | 1/1971 | Atkins | B08B 9/08 182/128 |
| 4,163,455 | A * | 8/1979 | Hebert | B05B 13/0636 134/167 R |
| 4,165,799 | A * | 8/1979 | Munoz | E04G 1/362 182/128 |
| 5,419,922 | A * | 5/1995 | Bajek | B05B 13/005 118/317 |
| 5,503,033 | A * | 4/1996 | Van Niekerk | B63B 57/00 73/865.8 |
| 6,566,834 | B1 * | 5/2003 | Albus | B25J 9/1623 318/566 |
| 8,397,334 | B2 * | 3/2013 | Ryffel | B08B 9/0813 15/56 |
| 10,406,571 | B2 * | 9/2019 | Innes | B08B 9/093 |
| 2008/0087497 | A1 * | 4/2008 | Boswell | A62B 1/02 182/142 |

FOREIGN PATENT DOCUMENTS

KR 20180002374 U * 8/2018 ..... B65D 90/0093

OTHER PUBLICATIONS

KR20180002374U English Translation (Year: 2018).*

* cited by examiner

*Primary Examiner* — Tyrone V Hall, Jr.
*Assistant Examiner* — Makena S Markman

(57) ABSTRACT

A maintenance device for remotely maintaining the inside of a structure, for example, by deploying a maintenance tool to remotely clean, sandblast using various blast media, and/or paint an interior surface of a building structure.

11 Claims, 6 Drawing Sheets

MAINTENANCE DEVICE

BACKGROUND INFORMATION

Field of the Invention

The invention relates to devices that are used to maintain large structures such as large capacity storage tanks, such as water towers, and more specifically related to devices that clean and paint such storage tanks.

Discussion of Prior Art

Large capacity storage tanks, such as water towers that store potable water and pressurize water delivery systems for municipalities, need a certain amount of maintenance over time. For example, at certain time intervals both the interior and exterior of these tanks must be sand blasted and repainted.

The maintenance efforts that occur inside these tanks is often quite hazardous, largely due to the enclosed design of the structure. In order to sand blast the existing paint from the interior walls of the tower a number of individuals must enter the structure and use sand blasting equipment to remove the existing paint. The heavy duty nature of the blasting equipment and the enclosed structure combine to create a virtual storm of paint dust and blasting media that is hazardous to breathe and that causes near blackout conditions. Full protective suits that include head gear and breathing apparatuses are required so that the workers are protected.

Many of these tanks and towers are quite tall and it is common for these structures to stand over 100 feet in height. As a result, the maintenance workers must use some form of climbing or elevating device to reach the majority of the tank. The height further endangers the workers in near-blackout conditions. Lastly, most of the structures have a cylindrical shape, which further complicates cleaning and painting the structure in a safe and efficient manner.

What is needed, therefore, is a remote controlled maintenance system that is able to clean and paint the interior of these structures while limiting the amount of time individual workers must be present inside the structure during the maintenance operation.

BRIEF SUMMARY

The invention is a maintenance device that remotely maintains the interior surface of a building structure by, for example, cleaning, sandblasting with a wide range of blast media, and/or painting the interior walls.

The maintenance device deploys a lifting system within a building structure that includes at least one support cable that extends from a locations at or near the top of the structure to a location at or near the bottom of the structure. At least a drive arm and a maintenance arm are coupled to this support cable and configured to move up and down along and around the support cable. The arms are also configured to move in an approximately circular direction around an interior surface of the structure, with the drive arm configured to move the arms in that circular motion while the maintenance arm is configured to perform a maintenance operation on the interior wall as the arms are in motion. Both the motion and the speed may vary depending on the area of the maintenance operation and the operation being performed, e.g. the arms may move faster or slower depending on the thickness of existing paint to remove.

The lifting systems includes at least one and likely three separate lifting devices, such as a traction hoist or winch. Each of the lifting devices is coupled to a lifting cable. One lifting cable is attached to the lifting device on one end and to a location at or near the top of the structure on an opposite end, and is configured to move raise and/or lower the lifting system within the structure. The other lifting cables are attached to the other lifting devices on one end and to outer portions of the drive arm and maintenance arms, respectively, so as to move the outer ends of the arms up or down as desired.

The support cable may be attached to the upper area of the structure by a swivel plate that allows the lifting system to move in the horizontal plane. Each of the lifting devices and the drive arm and maintenance arm may be attached to base plate that is slidably coupled to the support cable.

Together, the drive arm moves the maintenance arm around the inner surface of the structure while a maintenance tool on an end of the maintenance arm performs a maintenance operation. After one complete pass is made in the horizontal plane the lifting system raises or lowers the arms and another circular pass is made, with this process continuing as long as.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

Figure 1:
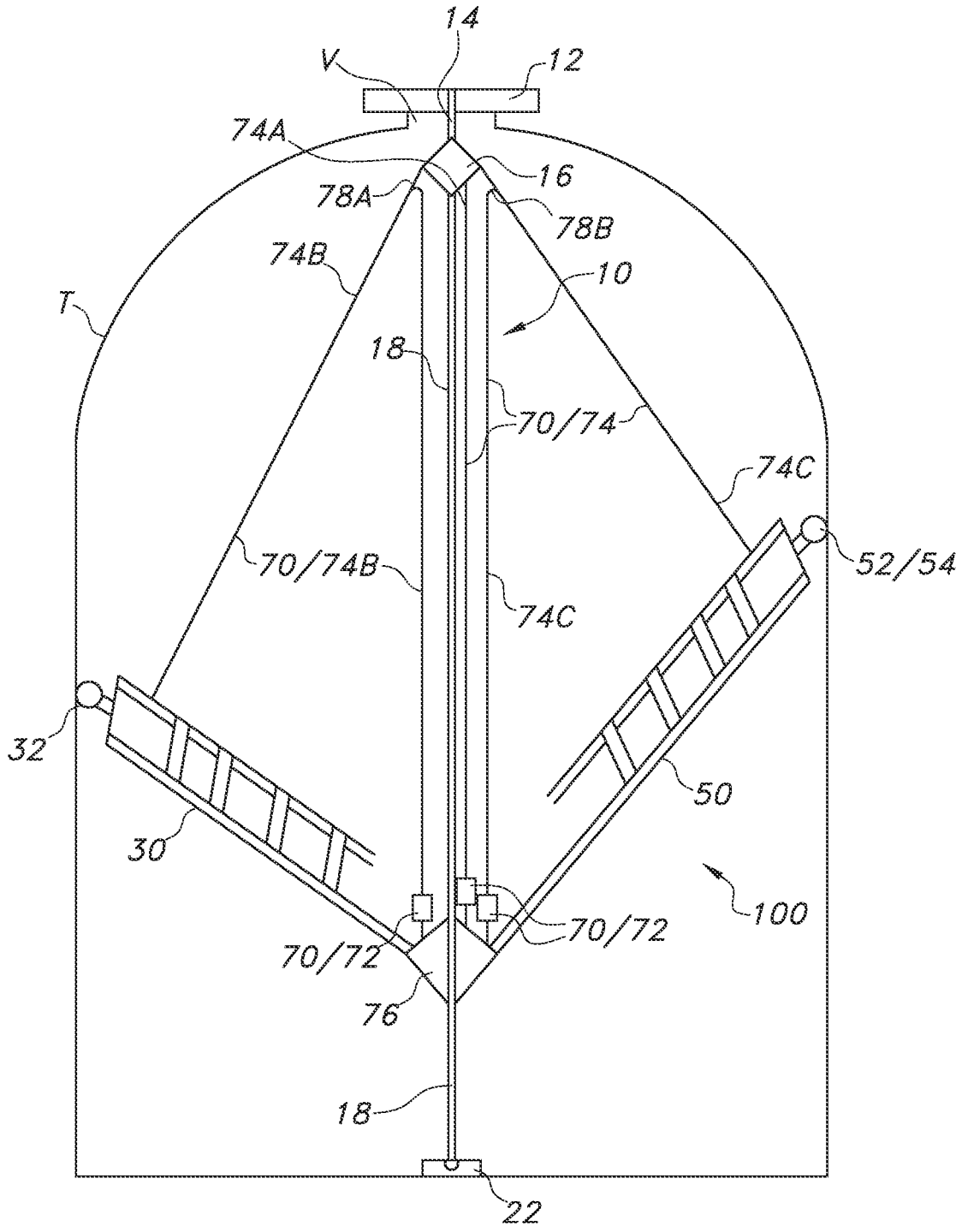
FIG. 1 is a cross sectional view of a storage tank in with the maintenance device, according to the invention, is in a position to sand blast existing paint from inner sides of the storage tank.
Figure 2:
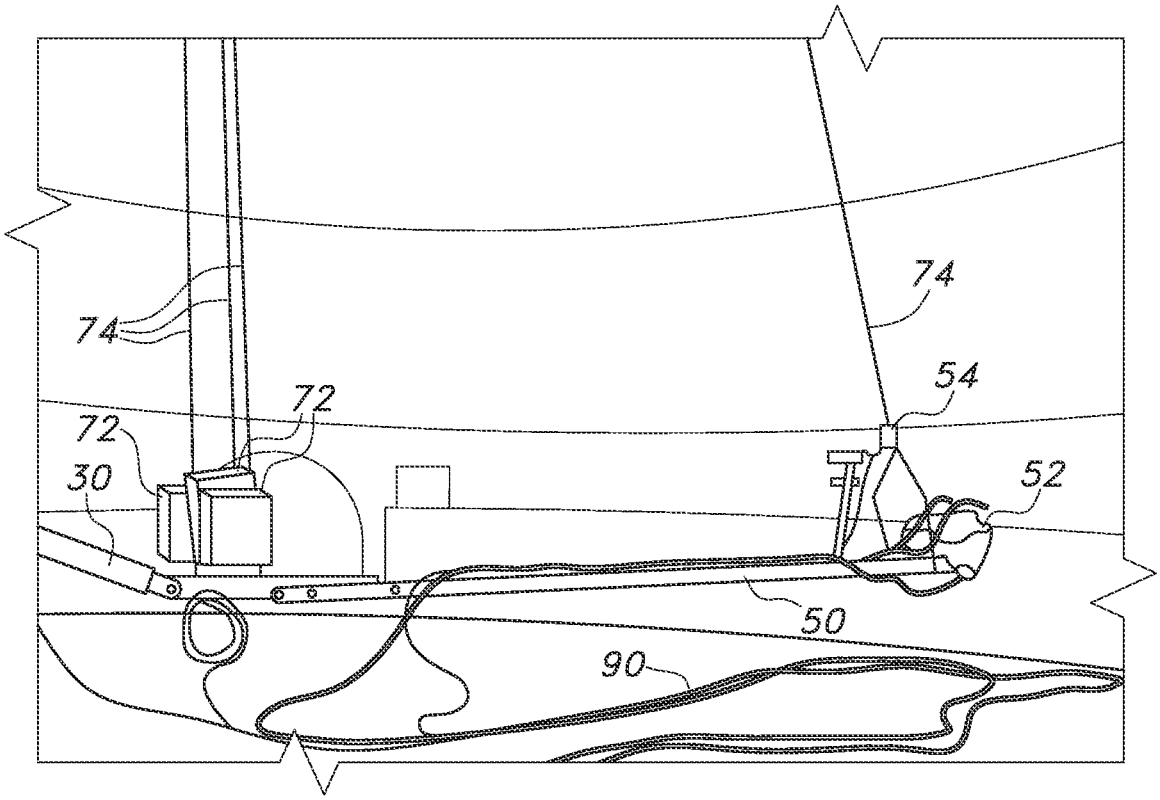
FIG. 2 is close-up view showing the maintenance arm and lifting motors.
Figure 3:
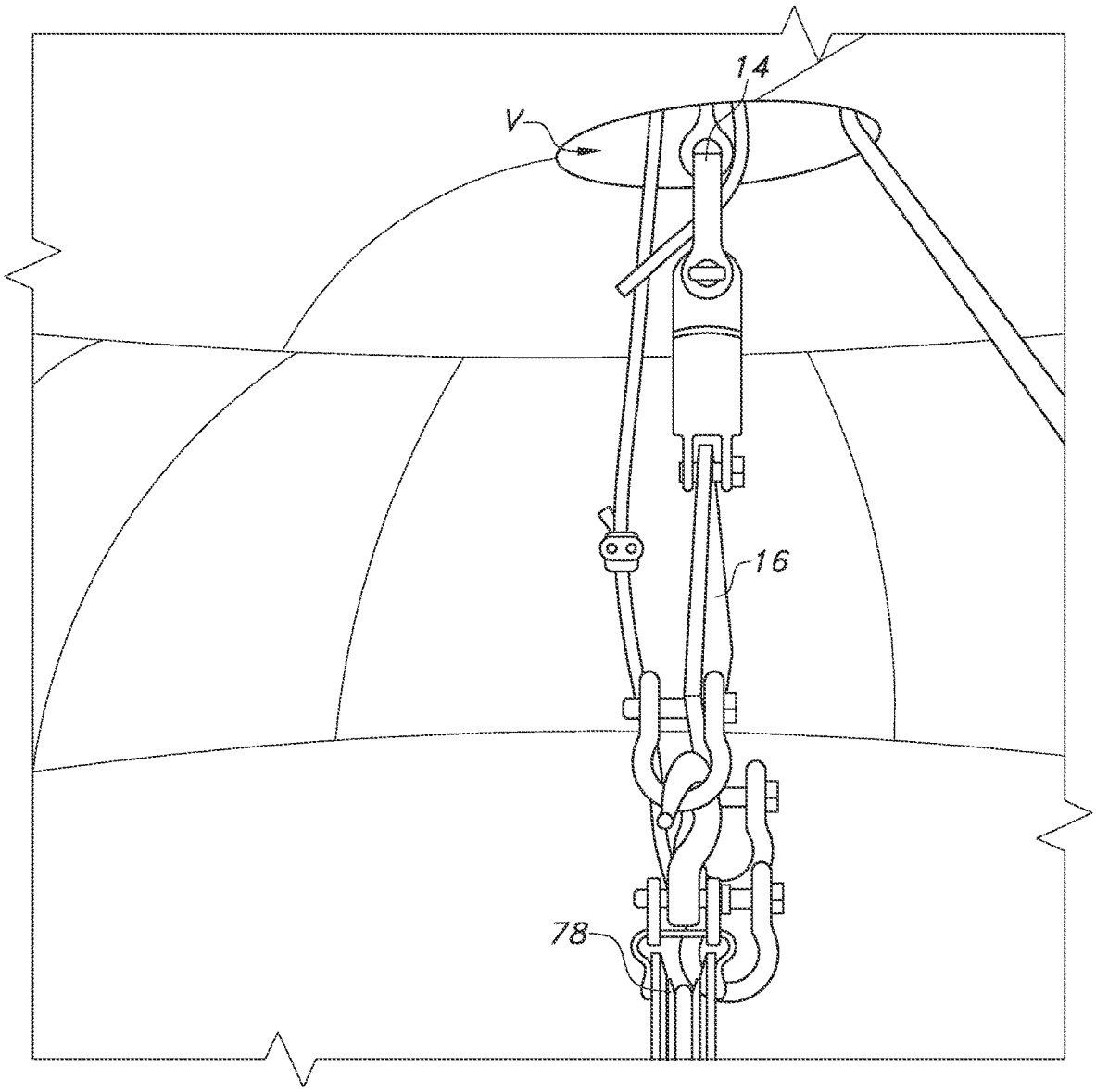
FIG. 3 is a close-up view showing the open air vent in the top of the tank and the upper portion of the maintenance device and support system.
Figure 4:
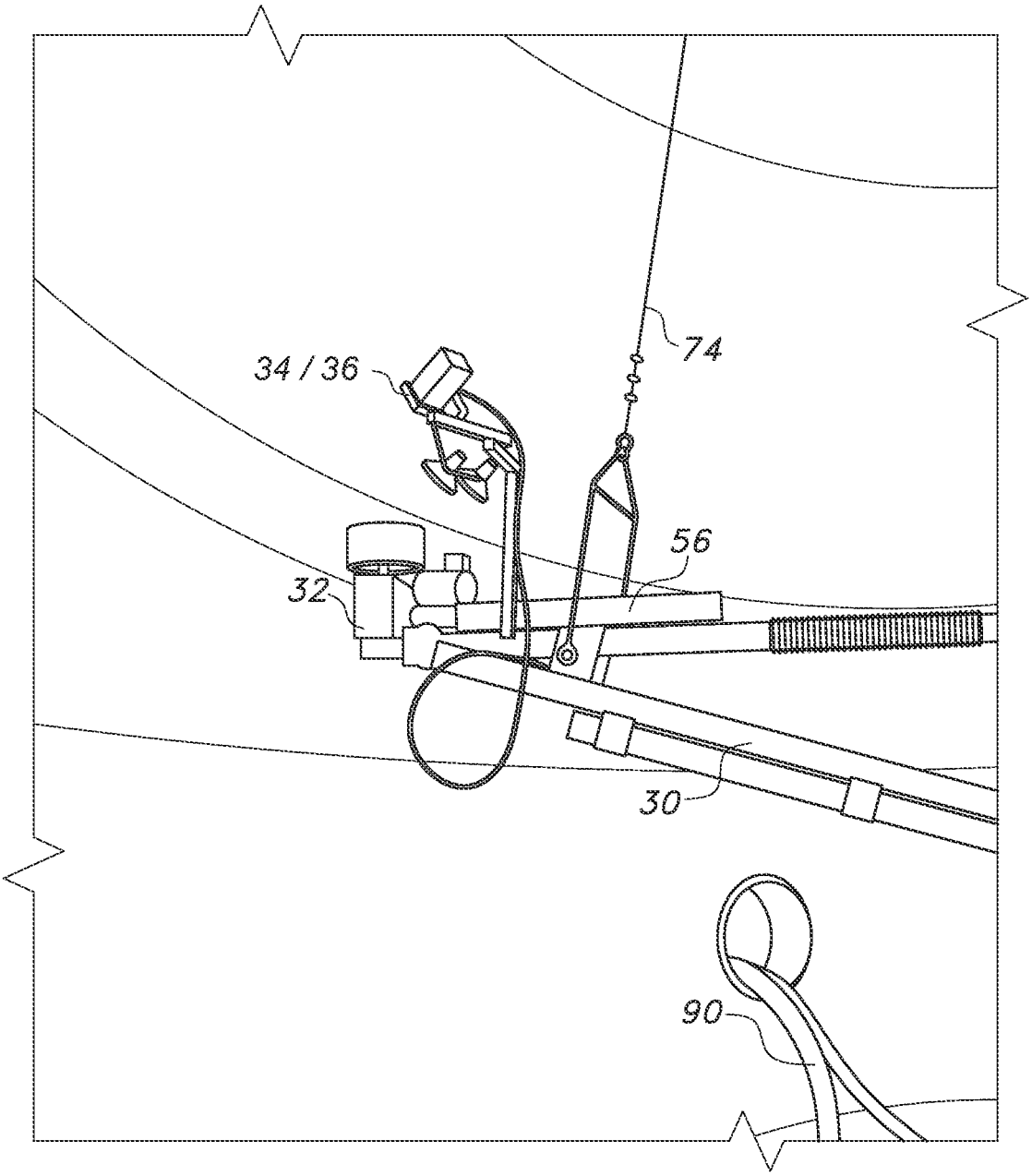
FIG. 4 is a close-up view of the drive arm.
Figure 5:
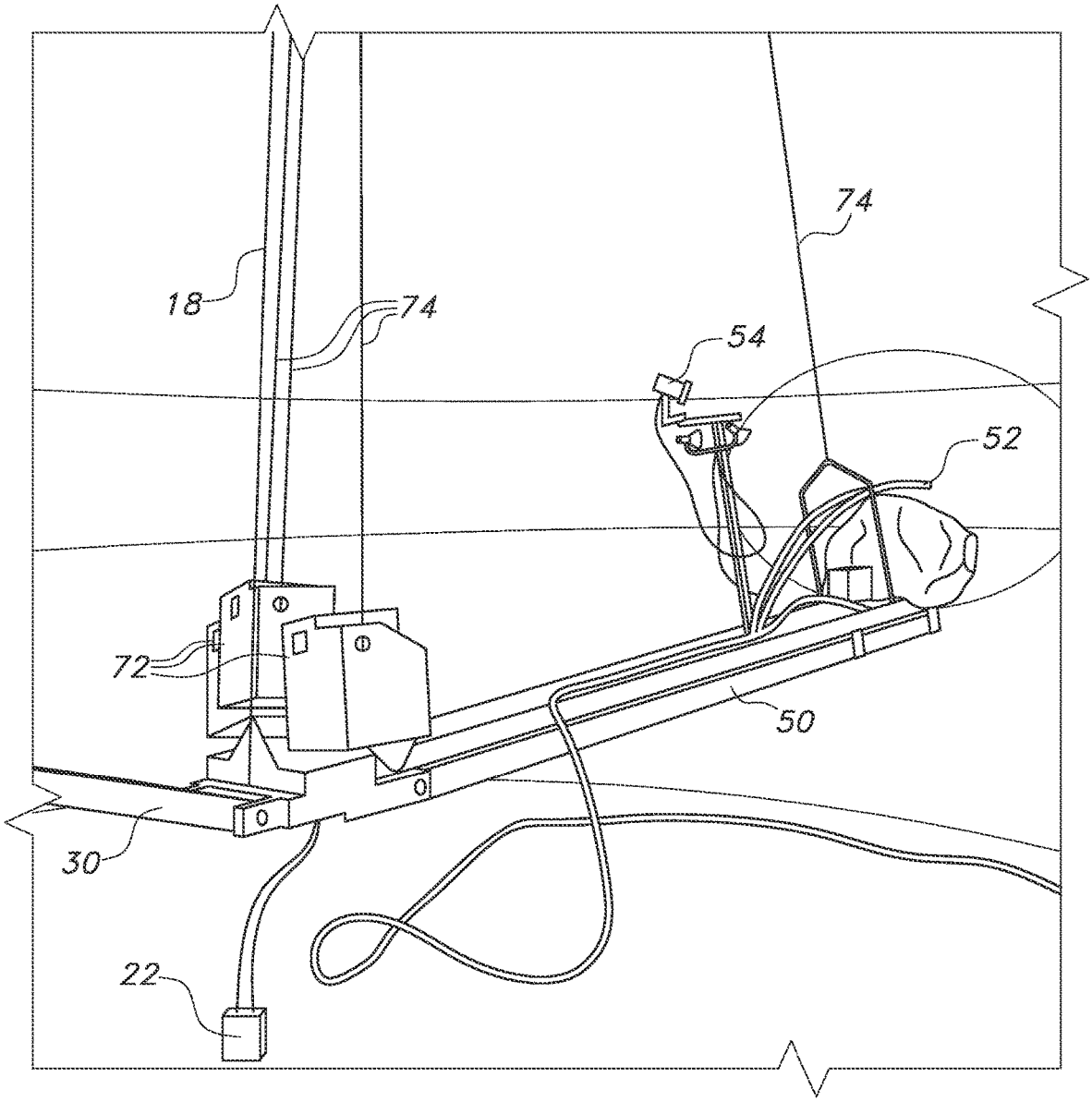
FIG. 5 is a close-up view of the lifting motors, maintenance arm, and a portion of the drive arm.
Figure 6:
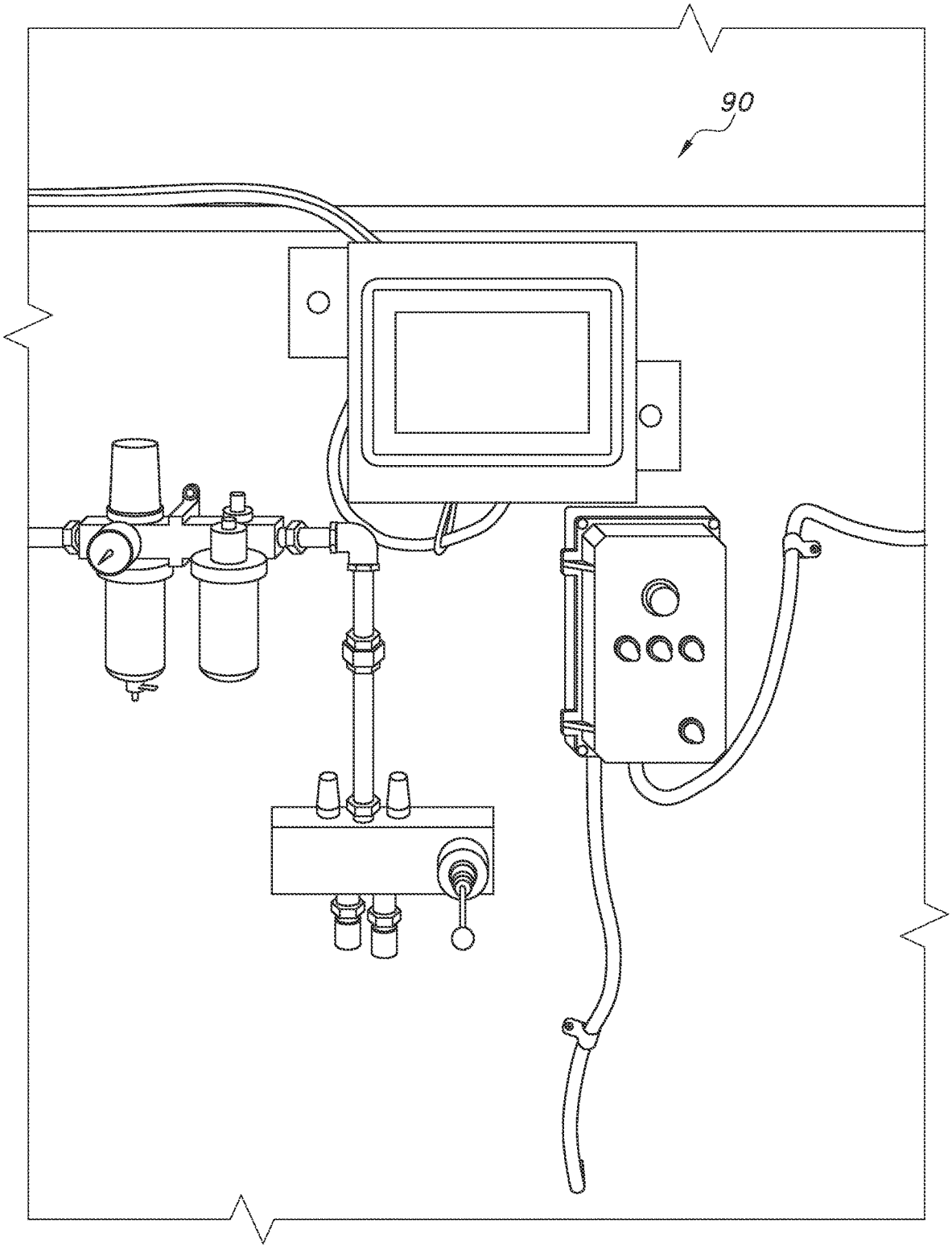
FIG. 6 is illustration of the remote control system.

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

FIGS. 1-6 illustrate a maintenance device 100 according to the invention in a working position inside a structure T, such as a conventional storage tank T. The structure T in this example has a large cylindrical shape with a dome shaped top, although this is merely an example use and the disclosure is not limited to this specific structure. The device 100 includes a support structure 10, a drive arm 30 that causes the device to rotate around the internal space of the thank T, a maintenance arm 50 that performs a maintenance task on the internal side wall of the tank T, and a lifting system 70 that moves the maintenance arm 50 and drive arm 30 up and down inside the tank T, the support structure 10 positioning and supporting the drive arm 30, maintenance arm 50, and lifting system 70 within the tank T. The maintenance device may also include a remote control system 90 to allow operational control of the system from the outside of the structure T.

In action, the maintenance device 100 is able to rotate 360 degrees in a horizontal plane while also moving from the top of the tank to the bottom of the tank in the vertical plane. In one embodiment, for example, the maintenance arm may be equipped with a sand blasting system. The arms 30, 50, in this embodiment start at the bottom of the tank T, the sand blasting system on the maintenance arm 50 is activated such that it starts removing paint from a portion of the interior wall, and the drive arm 30 is activated so that it moves the maintenance arm 50 in a 360 degree circle to blast the old paint off of a complete line around the interior wall. Once a full 360 degree path has been cleaned, the arms 30, 50 are raised to a position just above the cleaned surface, and another 360 degree path of paint is removed. The process may be repeated until all of the paint has been removed. The sand blasting equipment may additionally be adjusted to remove paint from the ceiling and/or floor of the tank as well as the sides of the tank, for example, by pointing the equipment at an angle. Alternatively, for example, the sand blasting system may be replaced with a painting system and the device may be used to apply paint to the interior of the tank T in the same manner.

In the embodiment shown in FIG. 1 the storage tank T is equipped with an air vent V located at a center position on the top of the dome. To use the device 100 in this situation the air vent V is removed and the support structure inserted in that opening. The support structure 10 is anchored to the top of the storage tank T, and in the embodiment shown specifically includes a beam 12 that is laid horizontally across the open vent such that it extends fully across the vent and is supported by either side of the vent, the beam 12 acting as an the anchor for the support structure 10. A first support cable 14 is secured using conventional means on one end to the beam and on the other end to a swivel plate 16, the swivel plate 16 being capable of rotating 360 degrees in the horizontal plane. The swivel plate 16 is connected to a second support cable 18 that extends to a securing device 22 that is secured to the floor of the tank T. For example, the securing device 22 may be a rigging pad that is welded to the floor of the tank T. The first cable 14 and second cable 18 are secured in a manner that leaves very little give or flexibility in the cable such that it acts in a manner similar to that of a steel pole and maintains a very ridged position.

It should be noted that this center opening and mounting is an example only and in no way limiting. For example, some structures that may be suitable for use with the device 100 may not have such a center opening and/or there may be other structural interferences within the structure that prevent the device from being mounted in this manner. In these situations, the first support cable 14 may be mounted using conventional means to other fixtures or through other openings at or near the top of the structure. Similarly, the securing device may be located at a non-central position and use other suitable conventional means aside from a welded rigging pad.

The beam 12 may be any suitable beam that has the strength necessary to hold the weight of the lifting system and arms. For example, using a beam that is a steel I-beam or steel square tubing that has a rim that measures 5/16 inch, with a height and width that each measure 4 inches, and a length of 4 feet.

The support cables 14, 18, must also have sufficient strength to support the lifting system 70 and arms 30, 50. For example, a ½ inch steel cable is generally sufficient. The rigging pad 22 must be securely affixed to floor of the tank, and is often a steel plate that is welded to the floor of the tank T.

The lifting system 70 includes one or more lifting motors 72, each of which operates in conjunction with one or more lifting cables 74. The lifting cables 74 are attached on one to the lifting motors 72 that are in turn connected to a base plate 76. The base plate 76 is slideably coupled to the second support cable 18 such that it may move up, down, and around along the second support cable 18. The lifting motors 72 may be any suitable motor such as, for example, traction hoists or conventional winches. One suitable example is the Spider SC1000 hoist-these that is controlled with handheld pendants for up/down operation.

In the embodiment shown, the lifting system 70 includes three lifting motors 72 and three lifting cables 74. As noted, all three lifting motors 72 are attached to the base plate 76. One of the lifting cables 74A is fixedly attached to the swivel plate 16 and is configure to move the base plate 76 up and down along the support cable 18. A second lifting cable 74B runs through a first pulley 78A and is connected to the end of the drive arm 30, while a third lifting cable 74C runs through a second pulley 78B and connects to a point near the end of the maintenance arm 50. In this configuration, the weight of the arms are largely supported by the lifting cables 74B, 74C. The pulley's may be any conventional pulley's that have sufficient strength to bear the weight of the other components.

The drive arm 30 is a telescoping arm that is connected to the base plate and extends outward to a position near the sidewall. At the end of the arm is an adjustable drive wheel 32 that extends outward and creates a firm connection against the sidewall such that the wheel pushes against the side and as the wheel rotates the friction with the wall causes the arm to move along the wall, which in turn rotates the base plate and as a result the maintenance arm 50. The telescoping movement may be performed manually or it may be automated and remote controlled, for example, the telescoping may be performed with a pneumatically controlled air cylinder 56. In the embodiment shown, the air cylinder 56 is able to push the arm outward and pull the arm back by an approximate distance of three feet. The air cylinder 56 may be operated by the control system 90. Many conventionally available wheels and motors may be suitable for use with the drive arm 30. For example, the BALDOR AGMA C1, having 0.75 horse power, 1750 rotations per minute is suitable, particularly for use with a wheel that measures 13×2.375×2.375, and is made of a polyurethane rubber on a steel-keyed drive wheel. Lights 34 and/or cameras 36 may be added to the drive arm 30 to assist a remote user in operating the system from outside of the tank T. There are many conventional cameras and lights that are suitable for this application. One suitable type of camera is the SMART PRO IP camera from HIKVISION which has enhanced low-light abilities.

The maintenance arm 50 is also a telescoping arm that is connected to the base plate and extends to a point near the tanks sidewall. A conventional maintenance tool 52 and/or tool system is affixed to the end of the maintenance arm. For example, blast nozzles may be attached to remove the existing paint from inside the structure, or an automated painting system, such as an conventional automatic spray gun may be used. There are a number of known blasters, blast nozzles, and blast media that are suitable for the various applications. For example, certain blasters and blast media are known to be best with paint removal while others may be more suitable for use on mold and mildew. When removing paint, for example, MARCO blast hoses that use steel grit as a blast media are sufficiently effective. In the embodiment shown, for example, two separate blast nozzles are connected to SERVO motors. The blast nozzles are attached to the blast hoses and may be easily removed to accommodate different size nozzles; for example, an ⅛" nozzle all the way up to a ¾" nozzle, and most often two ½" nozzle. The motors enable the nozzles to move in an up/down pattern as well as a left/right pattern This particular combination is configured to move in an up and down motion to blast a straight line area that is approximately 24 inches in length. Additional blast hoses may also be used.

Conventional lights and cameras 54 may also be added near an end location of the maintenance arm 50.

With both the drive arm 30 and maintenance arm 50 the telescoping movements are created and controlled using conventional means. These may be manual and/or automated.

Each of the lifting motors 72, the drive wheel 32, and the maintenance system 52, are controllable by the remote control system 90. The remote control system 90, may, for example, be comprised of a number of wired connections, where the wires extend out of the tank through the open vent and/or through other pre-existing access ports or doors to an external control area. The components may also be wirelessly controlled using any number of known technologies such as BLUETOOTH, WI-FI and/or other internet based or cellular based technologies.

The cameras 54 enable an operator to monitor the progress of the maintenance activity remotely and to make adjustments based on that progress. For example, if the paint is thick the system may need to revolve at a slower rate to properly remove all of the paint in one 360 degree sweep around the interior of the tank T.

In general, the device 100 may be operated in a number of manners to accomplish various tasks. However, one suitable method of operation is as follows:

1. Set drive wheel against the tank.
2. Start the blast head/nozzles.
3. Start drive wheel in either forward or reverse direction.
4. Begin a pass until a full 360 degrees is completed.
5. Once a full pass is completed stop the blasting operation.
6. Reverse the drive wheel and use the lights and cameras to inspect the blasted area.
7. Assuming the results are acceptable, retract the drive wheel and move the whole lifting system up and continue at step 1 again.

The speed at which the system operates varies depending on the task to be performed and the nature of the surface. For example, when blasting paint off the inside of a tank the time may vary as the thickness of the paint varies and thus some tanks require more blasting. However, in general, the system is configured to blast approximately 550-650 square feet per hours using two ½ inch nozzles.

It is understood that the embodiments described herein are merely illustrative of the present invention. Variations in the construction of the maintenance device may be contemplated by one skilled in the art without limiting the intended scope of the invention herein disclosed and as defined by the following claims.

The invention claimed is:

1. A device adapted to maintain an inner surface of a structure, the device comprising:

a support system that extends inside of the structure, the support system including a first support cable that is configured to maintain a rigid position inside the structure, the first support cable having an upper end and a lower end, the upper end anchored to a top portion of the structure, the lower end secured to a bottom portion of the structure;

a lifting system coupled to the support system inside the structure, the lifting system including a base plate that is movably coupled to the first support cable, the lifting system further including at least one lifting motor that includes a first lifting motor that is affixed to the base plate, the lifting system further including at least one lifting cable that includes a first lifting cable, the first lifting cable connected on a first end to the first lifting motor, the first lifting motor connected on a second end to a top portion of the structure, the first lifting motor adapted to move the base plate up and down along the first support cable;

a maintenance arm including at least one maintenance tool that is coupled to the lifting system, the maintenance arm configured to perform a maintenance action to the inner surface; and wherein the lifting system is configured to move the maintenance arm up and/or down within the structure.

2. The device of claim 1, further including a drive arm coupled to the support system, wherein the drive arm is configured to move the maintenance arm around the inner surface of the structure.

3. The device of claim 2, wherein the drive arm is configured to move the maintenance arm in an approximately horizontal plane within the structure and wherein the lifting system moves the drive arm and maintenance arm in an approximately vertical plane within the structure.

4. The device of claim 3, wherein the drive arm is coupled to the lifting system in a position approximately opposite a position of the maintenance arm.

5. The device of claim 2, wherein the lifting system includes a second lifting cable and a second lifting motor;

wherein the second lifting cable has a first end that is attached to the maintenance arm and a second end that is attached to the second lifting motor, the second lifting cable extending through a point at or near the top of the structure, the second lifting motor configured to move the maintenance arm in a vertical plane.

6. The device of claim 5, wherein the lifting system includes a third lifting cable and a third lifting motor;

wherein the third lifting cable has a first end that is attached to the drive arm and a second end that is attached to the third lifting motor, the third lifting cable extending through a point at or near the top of the structure, the third lifting motor configured to move the drive arm in a vertical plane.

7. The device of claim 6, wherein the drive arm is a telescoping arm.

8. The device of claim 6, wherein the maintenance arm is a telescoping arm.

9. The device of claim 1, wherein the support system is anchored to the top portion of the structure by a beam that extends across an opening of the structure.

10. The device of claim 9, wherein a swivel plate connects the beam to the first support cable and is configured to allow rotation of the lifting system about the inner side of the structure.

11. The device of claim 1, wherein the maintenance tool is a blasting device.

* * * * *